US009567988B2

(12) United States Patent
Ball-DiFazio

(10) Patent No.: US 9,567,988 B2
(45) Date of Patent: Feb. 14, 2017

(54) CRYOGENIC PUMP EMPLOYING TIN—GALLIUM ALLOYS AND METHODS OF USE

(75) Inventor: Doreen J. Ball-DiFazio, Hopkinton, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 1053 days.

(21) Appl. No.: 12/936,129

(22) PCT Filed: Apr. 3, 2009

(86) PCT No.: PCT/US2009/039419

§ 371 (c)(1),
(2), (4) Date: Jan. 24, 2011

(87) PCT Pub. No.: WO2009/146120

PCT Pub. Date: Dec. 3, 2009

(65) Prior Publication Data

US 2011/0126553 A1 Jun. 2, 2011

Related U.S. Application Data

(60) Provisional application No. 61/123,037, filed on Apr. 4, 2008.

(51) Int. Cl.
*F25B 9/00* (2006.01)
*F04B 37/08* (2006.01)
(Continued)

(52) U.S. Cl.
CPC ..... *F04B 37/08* (2013.01); *F04B 39/06* (2013.01); *F04B 53/08* (2013.01); *F25B 9/14* (2013.01);
(Continued)

(58) Field of Classification Search
CPC ..... C09K 5/14; F25B 2309/003; F25B 2309/1415; F25B 2309/1416; C22C 13/00
(Continued)

(56) References Cited

U.S. PATENT DOCUMENTS 4,272,290 A * 6/1981 Lesgourgues ..... 419/47
4,632,885 A * 12/1986 Tanabe et al. ..... 428/654
(Continued)

FOREIGN PATENT DOCUMENTS

CN 1973357 A 5/2007
JP 11-264618 9/1999
(Continued)

OTHER PUBLICATIONS

Kariya, Yoshiharu, et al. "Tin pest in Sn-0.5 wt.% Cu lead-free solder." JOM 53.6 (2001): 39-41.*
(Continued)

*Primary Examiner* — Ryan J Walters
*Assistant Examiner* — Christopher R Zerphey
(74) *Attorney, Agent, or Firm* — Hamilton, Brook, Smith & Reynolds, P.C.

(57) ABSTRACT

A cryogenic refrigerator includes a regenerative heat exchanger material in thermal contact with a working gas including a tin-antimony (Sn—Sb) alloy or a tin-gallium (Sn—Ga) alloy in at least one cooling stage. The regenerative heat exchanger material can include an Sn—Sb-M alloy, with M including at least one element selected from the group consisting of Bi, Ag, Ge, Cu, La, Mg, Mn, Nd, Ni, Pd, Pt, K, Rh, Sm, Se, S, Y, Fe, In, Al, Ce, Dy, Cd, Ti, Au, P, Pr, Yb and Zn. The cryogenic refrigerator can include a Gifford-McMahon refrigerator, a pulse tube refrigerator, or a Stirling refrigerator. A cryopump includes cryopanels adapted to condense or adsorb gases and a cryogenic refrigerator.

8 Claims, 10 Drawing Sheets

(51) Int. Cl.
*F04B 39/06* (2006.01)
*F04B 53/08* (2006.01)
*F25B 9/14* (2006.01)

(52) U.S. Cl.
CPC .. *F25B 2309/003* (2013.01); *F25B 2309/1415* (2013.01)

(58) Field of Classification Search
USPC ..... 62/6; 165/4
See application file for complete search history.

(56) References Cited

U.S. PATENT DOCUMENTS

| | | | | |
|---|---|---|---|---|
| 5,985,212 | A * | 11/1999 | Hwang | B23K 35/262 148/400 |
| 6,030,468 | A * | 2/2000 | Yagi et al. | 148/301 |
| 6,318,090 | B1 * | 11/2001 | Gschneidner, Jr. | F25B 9/14 62/6 |
| 6,325,138 | B1 * | 12/2001 | Garosshen et al. | 165/133 |
| 6,334,909 | B1 | 1/2002 | Okamura et al. | |
| 2005/0005736 | A1 * | 1/2005 | Ueshima | B23K 35/262 75/690 |
| 2005/0163642 | A1 | 7/2005 | Duron | |
| 2007/0122646 | A1 * | 5/2007 | Liu | C22C 13/00 428/646 |
| 2007/0227159 | A1 * | 10/2007 | Murayama et al. | 62/6 |
| 2007/0228109 | A1 * | 10/2007 | Smith | B23K 35/262 228/176 |
| 2010/0255998 | A1 * | 10/2010 | Buta | C22C 1/00 505/124 |
| 2012/0151938 | A1 * | 6/2012 | Przybylski et al. | 62/3.2 |

FOREIGN PATENT DOCUMENTS

| | | | | |
|---|---|---|---|---|
| JP | 11264618 | * | 9/1999 | F25B 9/00 |
| JP | 2004-099822 | A | 4/2004 | |
| JP | 2005-075963 | A | 3/2005 | |
| JP | 08-166173 | A | 7/2008 | |
| KR | 10-2007-0022215 | | 2/2007 | |
| TW | 200502034 | A | 1/2005 | |
| TW | 1490408 | * | 7/2015 | F04B 37/08 |
| WO | WO 00/77398 | A1 | 12/2000 | |
| WO | WO 2006 022297 | A1 | 3/2006 | |

OTHER PUBLICATIONS

Translation of JP11264618.*
Translation of WO2006022297.*
Notification Concerning Transmittal of International Preliminary Report on Patentability for Int'l Application No. PCT/US2009/039419, Date of Mailing: Oct. 14, 2010.
Korean Office Action for Application No. 10-2010-7024831, Date of Mailing: May 13, 2015.
Kariya, Y., et al., "Tin Pest in Sn-0.5 wt.% Cu Lead-Free Solder," *JOM*, pp. 39-41 (Jun. 2001).
Korean Office Action for Application No. 10-2010-7024831, Date of Mailing: Dec. 13, 2015.
Office Action for Japan Application No. 200980120523.7, dated Apr. 14, 2016.
Office Action for Taiwan Application No. 104111216, dated Jul. 15, 2016.
Notification of Transmittal of the International Search Report and the Written Opinion of the International Searching Authority, or the Declaration, International Application No. PCT/US2009/039419, date of mailing, Oct. 19, 2009.

* cited by examiner

CRYOGENIC PUMP EMPLOYING TIN—GALLIUM ALLOYS AND METHODS OF USE

RELATED APPLICATION

This application is the U.S. National Stage of International Application No. PCT/US2009/039419, filed Apr. 3, 2009, which designates the U.S., published in English, and claims the benefit of U.S. Provisional Application No. 61/123,037, filed Apr. 4, 2008. The entire teachings of the above applications are incorporated herein by reference.

BACKGROUND OF THE INVENTION

Currently available cryogenic vacuum pumps (cryopumps) generally follow a common design concept. A low temperature array, usually operating in the range of 4 to 25 K, is the primary pumping surface. This surface is surrounded by a higher temperature radiation shield, usually operated in the temperature range of 60 to 130 K. The radiation shield protects the lower temperature array from radiated heat. The radiation shield generally includes a housing which is closed except at an opening where a frontal array is positioned between the primary pumping surface and a work chamber to be evacuated.

During operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, a vacuum is created in the work chamber.

In systems cooled by closed-cycle cryocoolers, the cooler is typically a two-stage refrigerator having a cold finger which extends through the rear or side of the radiation shield. High pressure helium refrigerant is generally delivered to the refrigerator through high pressure lines from a compressor assembly. Electrical power to a displacer drive motor in the cooler is usually also delivered through the compressor or a controller assembly.

The radiation shield is connected to a heat sink, or cold station, at the coldest end of the first stage of the refrigerator. The shield surrounds the second stage cryopanel in such a way as to protect it from radiant heat. The frontal array is cooled by the first stage heat sink through its attachment to the radiation shield or, as disclosed in U.S. Pat. No. 4,356,701, through thermal struts.

The coldest end of the second, coldest stage of the cryocooler is at the tip of the cold finger. The primary pumping surface, or cryopanel, is connected to a heat sink at this coldest end of the second stage. This cryopanel may be a simple metal plate or cup, or it may be an array of metal baffles arranged around and connected to the second-stage heat sink. This second stage cryopanel also supports the low temperature adsorbent.

As part of the sophisticated technology employed to produce the utmost dependability and the highest efficiency of cryopumps, much effort has been devoted to the selection of materials for the regenerative heat exchangers in cryogenic refrigerators such as Gifford-McMahon, Stirling, and pulse tube cryogenic refrigerators. Regenerative heat exchangers which exhibit high volumetric heat capacities at low temperatures are normally preferred. As shown in FIG. 1, most metals, however, exhibit a sharp decrease in volumetric heat capacity with decreasing temperature below 75 K, in contrast with helium, whose volumetric heat capacity increases sharply below 25 K, peaking at approximately 10 K. The specific heat values shown in FIG. 1 for tin, antimony, helium, and lead are obtained from reference data, as disclosed in *Thermophysical Properties of Matter: Specific Heat: Metallic Elements and Alloys*, Y. S. Touloukian and E. H. Buyco, Vol. 4, and *Specific Heat: Nonmetallic Liquids and Gases*, Y. S. Touloukian and T. Makita, Vol. 6 (IFI/Plenum, New York 1970), the entire teachings of which are incorporated herein by reference. The specific heat values shown in FIG. 1 for mixtures of two or more metals are calculated by adjusting the known specific heat values of the pure metals by the percent composition in the indicated mixtures. Cryogenic refrigerators typically use lead (Pb) as a component of the second stage regenerative heat exchanger, because lead has a relatively high volumetric heat capacity at cryogenic temperatures.

Lead, however, is a poisonous metal that can damage nervous systems, especially in young children, and cause blood and brain disorders. Long term exposure to lead or its salts (especially soluble salts or the strong oxidant $PbO_2$) can cause nephropathy, and colic-like abdominal pains. Therefore, the use of lead in products is now either banned, restricted or undesirable.

Other regenerative materials, too, have disadvantages. For example, rare-earth containing intermetallic compounds are extremely expensive. In addition, intermetallic materials are harder and more brittle than metal compounds, and, therefore, are difficult to produce in the geometries needed for the regenerative heat exchangers in cryogenic refrigerators. These materials also have relatively poor performance because they can easily disintegrate into powder when exposed to repeated mechanical shocks during normal refrigerator operation. Bismuth is another metal with high volumetric heat capacity, but it is very expensive, brittle, and difficult to fabricate into the spherical shape needed for regenerator material. Bismuth can also disintegrate into powder like the intermetallic compounds, with the added disadvantage that bismuth powder is highly flammable and reactive with aluminum and air. Aluminum is a common material of construction in cryogenic refrigerators and thus the powder may react when the refrigerator is disassembled in air.

As such, there is a need for less hazardous and inexpensive regenerative heat exchanger materials with high volumetric heat capacity that don't have the potential to degrade over time during operation and are able to be formed into the required geometry.

SUMMARY OF THE INVENTION

In one embodiment, the invention includes a cryogenic refrigerator that comprises a regenerative heat exchanger material of a tin-antimony (Sn—Sb) alloy in thermal contact with a working gas in at least one cooling stage. In a specific embodiment, the cryogenic refrigerator is a Gifford-McMahon cryogenic refrigerator. In another specific embodiment, the cryogenic refrigerator is a pulse tube cryogenic refrigerator. In yet another specific embodiment, the cryogenic refrigerator is a Stirling cryogenic refrigerator. In yet another embodiment, the working gas is helium. In some embodiments, the cooling stage includes at least two layers of regenerative heat exchanger material. In certain embodiments, at least one layer includes a tin-antimony (Sn—Sb)

alloy, and at least one layer includes at least one rare earth element. In certain other embodiments, at least one layer includes a tin-antimony (Sn—Sb) alloy, and at least one layer includes a rare earth intermetallic compound of one or more rare earth elements with a non-rare earth metal. In yet other embodiments, at least one layer includes a tin-antimony (Sn—Sb) alloy, and at least one layer includes a solid solution alloy of rare earth elements. In a specific embodiment, the Sn—Sb alloy comprises a maximum of about 43% antimony by weight, preferably about 9.6% antimony by weight, and more preferably about 6.7% antimony by weight. In another specific embodiment, the Sn—Sb alloy comprises a minimum of about 0.5% antimony by weight. In another embodiment, the Sn—Sb alloy includes substantially spherical tin-antimony alloy particulates, in a diameter range of between about 0.01 mm and about 3 mm.

In another embodiment of the cryogenic refrigerator, the cooling stage further includes a cold station in direct thermal contact with the working gas. In a specific embodiment, the cold station is substantially composed of copper.

In another embodiment of the cryogenic refrigerator, the regenerative heat exchanging material includes a Sn—Sb-M alloy. M can include at least one element selected from the group consisting of Bi, Ag, Ge, Cu, La, Mg, Mn, Nd, Ni, Pd, Pt, K, Rh, Sm, Se, S, Y, Fe, In, Cd, Ti, Al, Ce, Dy, Au, P, Pr, Yb, and Zn, from about 0.01% to about 40% of M by weight, from about 0.1% to about 43% of Sb by weight, and from about 50% to about 99.5% of Sn by weight. In some embodiments, the cooling stage includes at least two layers of regenerative heat exchanger material. In certain embodiments, at least one layer includes a Sn—Sb-M alloy, and at least one layer includes at least one rare earth element. In certain other embodiments, at least one layer includes a Sn—Sb-M alloy, and at least one layer includes a rare earth intermetallic compound of one or more rare earth elements with a non-rare earth metal. In yet other embodiments, at least one layer includes a Sn—Sb-M alloy, and at least one layer includes a solid solution alloy of rare earth elements. In a specific embodiment, the Sn—Sb-M alloy includes substantially spherical Sn—Sb-M particulates, in a diameter range of between about 0.01 mm and about 3 mm.

In another embodiment, the invention includes a cryopump that comprises a cryogenic refrigerator that includes at least one cooling stage containing a working gas adapted to be a cryogenic refrigerant, and containing at least one cold station in thermal contact with the at least one cooling stage, a regenerative heat exchanger material in thermal contact with the working gas, the regenerative heat exchanger material including a tin-antimony (Sn—Sb) alloy, and at least one cryopanel adapted to condense or adsorb gases, connected to the at least one cold station. In a specific embodiment, the Sn—Sb alloy comprises a maximum of about 43% antimony by weight, preferably about 9.6% antimony by weight, and more preferably about 6.7% antimony by weight. In another specific embodiment, the Sn—Sb alloy comprises a minimum of about 0.5% antimony by weight. In a specific embodiment, the cryogenic refrigerator is a Gifford-McMahon cryogenic refrigerator. In another specific embodiment, the cryogenic refrigerator is a pulse tube cryogenic refrigerator. In yet another specific embodiment, the cryogenic refrigerator is a Stirling cryogenic refrigerator. In some embodiments, the working gas is helium. In another embodiment, the cryopump comprises a regenerative heat exchanger material that includes an Sn—Sb-M alloy. M can include at least one element selected from the group consisting of Bi, Ag, Ge, Cu, La, Mg, Mn, Nd, Ni, Pd, Pt, K, Rh, Sm, Se, S, Y, Fe, In, Cd, Ti, Al, Ce, Dy, Au, P, Pr, Yb, and Zn, from about 0.01% to about 40% of M by weight, from about 0.1% to about 43% of Sb by weight, and from about 50% to about 99.5% of Sn by weight.

In another embodiment, the invention includes a cryopump that comprises a Gifford-McMahon cryogenic refrigerator that includes a reciprocating displacer within a cryogenic refrigerator with first and second coaxial stages, the displacer being driven in reciprocating motion alternately compressing and expanding a working gas adapted to be a cryogenic refrigerant, a regenerative heat exchanger material in the displacer in thermal contact with the working gas, the regenerative heat exchanger material including a tin-antimony (Sn—Sb) alloy, and at least one cryopanel adapted to condense or adsorb gases, connected to the second coaxial stage. In a specific embodiment, the Sn—Sb alloy comprises a maximum of about 43% antimony by weight, preferably about 9.6% antimony by weight, and more preferably about 6.7% antimony by weight. In another specific embodiment, the Sn—Sb alloy comprises a minimum of about 0.5% antimony by weight.

In another embodiment of the cryopump that comprises a Gifford-McMahon cryogenic refrigerator, the regenerative heat exchanger material includes an Sn—Sb-M alloy. M can include at least one element selected from the group consisting of Bi, Ag, Ge, Cu, La, Mg, Mn, Nd, Ni, Pd, Pt, K, Rh, Sm, Se, S, Y, Fe, In, Cd, Ti, Al, Ce, Dy, Au, P, Pr, Yb, and Zn, from about 0.01% to about 40% of M by weight, from about 0.1% to about 43% of Sb by weight, and from about 50% to about 99.5% of Sn by weight.

In still another embodiment, the invention includes a cryopump that comprises a pulse tube cryogenic refrigerator that includes a buffer tank configured to contain a volume of a working gas adapted to be a cryogenic refrigerant, a first heat exchange region in fluid communication with the buffer tank, a pulse tube in fluid communication with the first heat exchange region, configured to transmit a gas pressure wave along the pulse tube, a second heat exchange region in fluid communication with the pulse tube, a cavity in fluid communication with the second heat exchange region, the cavity containing a regenerative heat exchanger material in thermal contact with the working gas, the regenerative heat exchanger material including a tin-antimony (Sn—Sb) alloy, a source of gas pressure adapted to create a gas pressure wave, and at least one cryopanel adapted to condense or adsorb gases, connected to the second heat exchange region. In a specific embodiment, the cryopump further includes a flow restriction orifice in fluid communication with the buffer tank and with the first heat exchange region. In another specific embodiment, the flow restriction orifice further includes an adjustable opening. In yet another specific embodiment, the source of gas pressure is a reciprocating displacer, the displacer being driven in reciprocating motion, alternately compressing and expanding the working gas. In some embodiments, the working gas is helium. In another specific embodiment, the regenerative heat exchanger material includes at least two layers. In yet another specific embodiment, the cryopump includes a cold station in direct thermal contact with the working gas. In a specific embodiment, the cold station is substantially composed of copper. In yet another specific embodiment, the Sn—Sb alloy comprises a maximum of about 43% antimony by weight, preferably about 9.6% antimony by weight, and more preferably about 6.7% antimony by weight. In another specific embodiment, the Sn—Sb alloy comprises a minimum of about 0.5% antimony by weight. In another embodiment, the regenerative heat exchanger material includes an Sn—Sb-M alloy. M can include at least one element selected from the group consisting of Bi, Ag, Ge, Cu, La, Mg, Mn, Nd, Ni, Pd, Pt, K, Rh, Sm, Se, S, Y, Fe, In, Cd, Ti, Al, Ce, Dy, Au, P, Pr, Yb, and Zn, from about 0.01% to about 40% of M by weight, from about 0.1% to about 43% of Sb by weight, and from about 50% to about 99.5% of Sn by weight.

In yet another embodiment, the invention includes a cryogenic refrigerator that comprises a regenerative heat exchanger material of a tin-gallium (Sn—Ga) alloy in thermal contact with a working gas in at least one cooling stage. In a specific embodiment, the cryogenic refrigerator is a Gifford-McMahon cryogenic refrigerator. In another specific embodiment, the cryogenic refrigerator is a pulse tube cryogenic refrigerator. In yet another specific embodiment, the cryogenic refrigerator is a Stirling cryogenic refrigerator. In some embodiments, the working gas is helium. In some embodiments, the cooling stage includes at least two layers of regenerative heat exchanger material. In certain embodiments, at least one layer includes a tin-gallium (Sn—Ga) alloy, and at least one layer includes at least one rare earth element. In certain other embodiments, at least one layer includes a tin-gallium (Sn—Ga) alloy, and at least one layer includes a rare earth intermetallic compound of one or more rare earth elements with a non-rare earth metal. In yet other embodiments, at least one layer includes a tin-gallium (Sn—Ga) alloy, and at least one layer includes a solid solution alloy of rare earth elements. In a specific embodiment, the Sn—Ga alloy comprises a maximum of about 3.9% gallium by weight.

In still another embodiment, the invention includes a method of operating a cryopump at cryogenic temperature. The method comprises reciprocating a displacer within a cold-accumulating unit of the cryopump. The displacer houses a regenerative heat exchanger material that includes a tin-antimony alloy. A working gas is introduced into the cold-accumulating unit under pressure, and then expanded by the displacer, thereby cooling the gas, which, in turn, cools the regenerative heat exchanger material. In a specific embodiment, the working gas is helium.

In another embodiment, the invention includes a method of operating a cryopump at cryogenic temperature that comprises providing at least one cooling stage containing a working gas adapted to be a cryogenic refrigerant, and containing at least one cold station in thermal contact with the at least one cooling stage, and a regenerative heat exchanger material in thermal contact with the working gas, the regenerative heat exchanger material including a tin-antimony (Sn—Sb) alloy. The method further includes condensing or adsorbing gases on at least one cryopanel connected to the at least one cold station.

In still another embodiment, the regenerative heat exchanger material that includes a tin-antimony alloy is not contained in a moving displacer and instead is in a fixed bed with pressure pulses traversing the working gas across the regenerative heat exchanger material. In a specific embodiment, the working gas is helium.

The invention is advantageous in that it provides less hazardous and inexpensive regenerative heat exchanger materials including tin-antimony (Sn—Sb) alloys with high volumetric heat capacity that don't have the potential to degrade over time during operation and are able to be formed into the required geometry for cryogenic refrigerators. Cryogenic vacuum pumps that include regenerative heat exchanger materials of this invention as part of lead-free cryogenic refrigerators provide clean vacuum environments for semiconductor manufacturing and other electronics manufacturing processes.

DETAILED DESCRIPTION OF THE INVENTION

Figure 1:
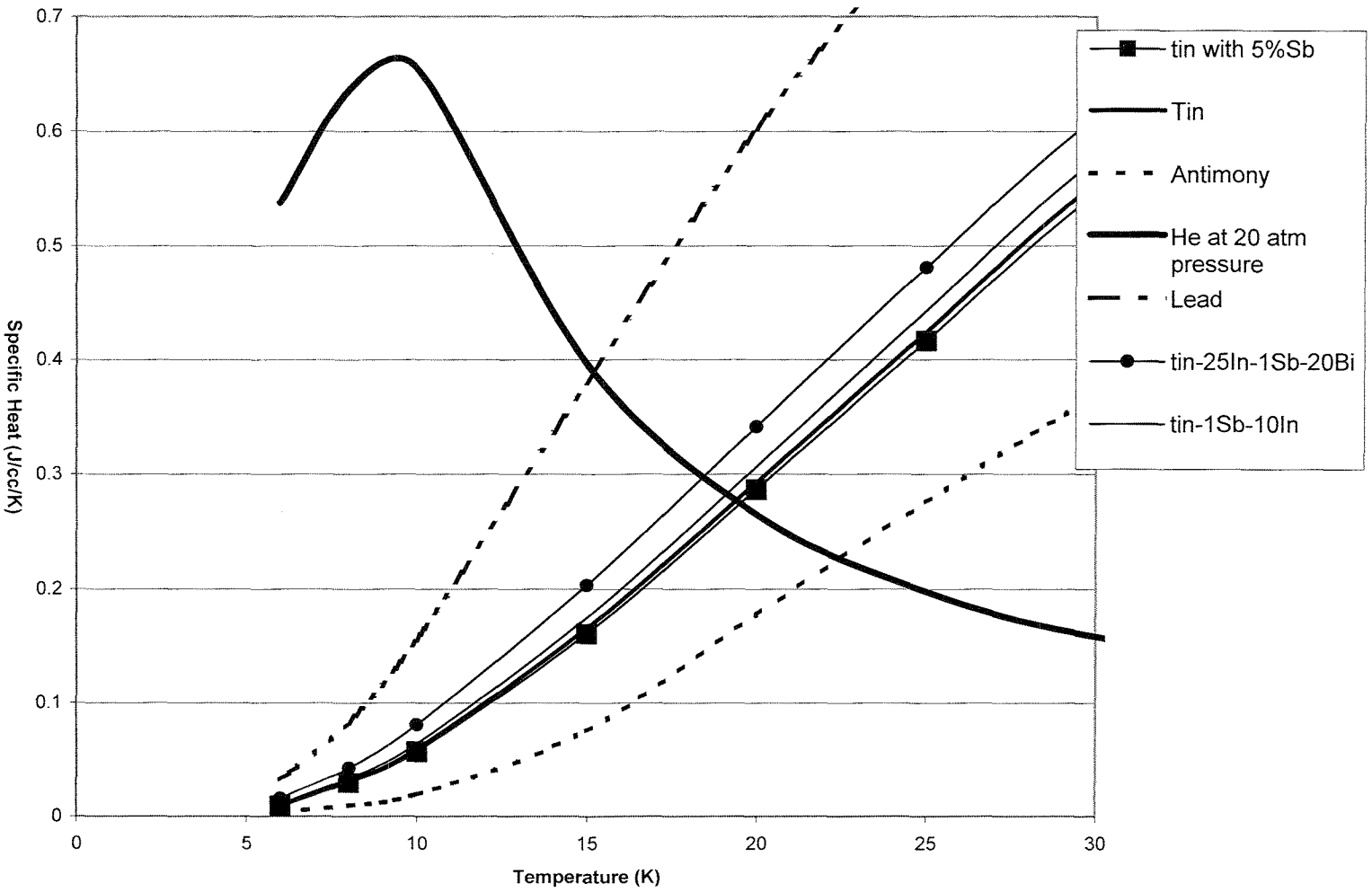
FIG. 1 is a graph of volumetric specific heat values as a function of temperature for several metals and combinations of two or more metals and helium gas.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

Metallic tin (Sn) is generally non-toxic to humans, even upon uptake of small concentrations for a long period of time, and elemental tin rarely affects human health. As such, tin is an environmentally sensible substitute for lead as a regenerative heat exchanger material applied to cryogenic refrigerators in cryopumps, without significantly compromising volumetric heat capacity as shown in FIG. 1.

Tin has two allotropes at normal pressure and temperature: gray alpha ($\alpha$)-tin and white beta ($\beta$)-tin. Below 13.2° C. at equilibrium, it exists as $\alpha$-tin, which has a cubic crystal structure similar to silicon and germanium. Gray tin has poor metallic properties; it is a dull-gray brittle material. When warmed above 13.2° C. at equilibrium, tin changes into white or $\beta$-tin, which is a ductile metal with a tetragonal structure. Alpha tin can cause undesirable effects in applications where the ductile properties of tin are important and the transformation results in powdering of the transformed material because of the stresses that result from the volume change associated with the transformation. The transformation of β-tin to α-tin also occurs slowly when held for a long time below 13.2° C. Incubation times for the formation of α-tin can range from months to more than a year. The transformation involves an incubation time in which the alpha phase nucleates at the surface, and a growth phase in which the alpha phase grows into the beta phase over time. The result can be a metallic surface of white tin that becomes covered with a gray powder which is easily rubbed off. This process is known as tin disease or tin pest.

Regenerative heat exchanger materials made of gray or alpha tin are unsuited to be applied in cryogenic cycles, because the low temperature surfaces of cryopumps operate in the range of 4 to 70 K (−269° C. to −203° C.) and cycle between room temperature and the cold operating range for regular maintenance and regeneration. The transformation to gray tin is prevented by the addition of antimony (Sb), in sufficient quantity, forming an alloy of tin and antimony. Tin alloys containing one or more of lead and bismuth in sufficient quantities or in combination resulting in sufficient quantities will also eliminate the transformation to α-tin. The inclusion of additional elements to enhance properties such as volumetric heat capacity and ductility and minimize thermal conductivity may be included as long as the minimum amount of the inhibiting element is included in the alloy. These alloying elements include but are not limited to: In, Ag, Au, Cd, Ti, Ni, Bi, Ge, Cu, Mg, Mn, Pd, Pt, K, Rh, Se, S, Y, Fe, Al, P, Yb, Zn, and the rare-earth elements.

As such, in certain embodiments of the present invention, the regenerative heat exchanger material for operating a cryogenic refrigerator includes tin-antimony (Sn—Sb) alloy. The regenerative heat exchanger material can generally comprise a plurality of phases, each having a different composition ratio and impurity phases such as oxide and carbide.

In one embodiment, the Sn—Sb alloy can include up to the maximum solid solubility of about 9.6% Sb by weight with a minimum concentration of about 0.5% Sb by weight. Compositions can include up to about 43% Sb by weight.

In certain other embodiments, the regenerative heat exchanger material for operating a cryogenic refrigerator includes a tin-gallium (Sn—Ga) alloy. In one embodiment, the Sn—Ga alloy can include up to the maximum solid solubility of about 3.9% Ga by weight.

In certain embodiments, the regenerative heat exchanger material can be a ternary alloy following the general formula Sn—Sb-M, wherein M is an element selected from the group consisting of Bi, Ag, Ge, Cu, La, Mg, Mn, Nd, Ni, Pd, Pt, K, Rh, Sm, Se, S, Y, Fe, In, Al, Ce, Dy, Cd, Ti, Au, P, Pr, Yb, Er, Ho, Gd, and Zn. In certain embodiments, the Sn—Sb-M alloy material can include from about 0.01% to about 40% of M by weight, from about 0.1% to about 43% of Sb by weight, and from about 50% to about 99.5% of Sn by weight.

Preferably, the regenerative heat exchanger materials of the present invention are comprised of spheres having substantially uniform diameters, in order to provide for minimization of pressure drop along the flow direction of the operating medium (refrigerant), such as helium (He) gas, in a cold-accumulating unit packed with the regenerative heat exchanger material, and in order to increase the heat exchange efficiency between the operating medium and the regenerative heat exchanger material, and to maintain a constant rate of heat exchange within the cold-accumulating unit.

The size of the regenerative heat exchanger material is a factor that has a large influence upon the cooling functions and the heat transfer characteristics of the refrigerator. In one embodiment, the diameter range of the substantially spherical regenerative heat exchanger material is in a range of between about 0.01 mm and about 3 mm.

Figure 2:
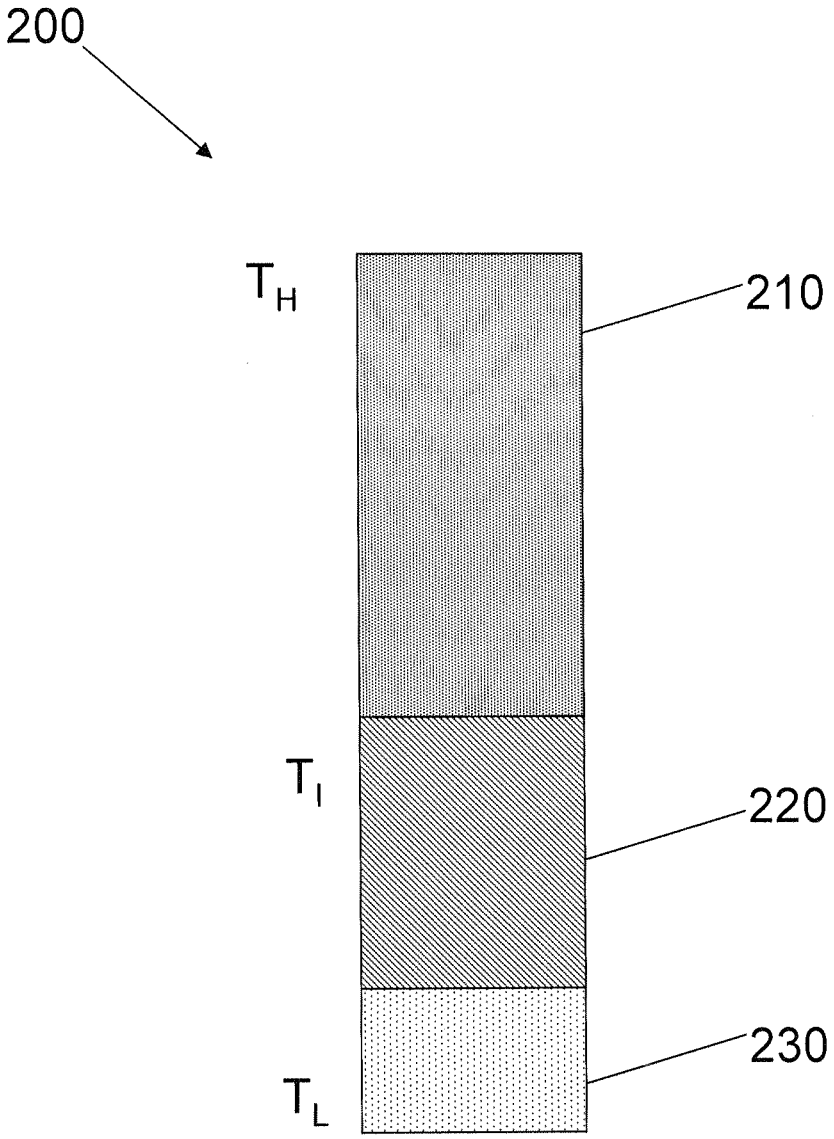
FIG. 2 is a cross section view of three layers of regenerative heat exchanger materials and corresponding relative temperature distribution.

In an additional embodiment shown in FIG. 2, regenerator heat exchanger 200 may contain layers of materials 210, 220, and 230, with various volumetric heat capacities as appropriate to the temperature at the respective location in the regenerator, a high temperature $T_H$ at one end 210, a lower intermediate temperature $T_I$ in the middle 220, and a low temperature $T_L$ at the other end of the regenerator 230. The regenerative heat exchanger materials of this invention will be included in at least one of the layers. In certain embodiments, at least one layer includes a tin-antimony (Sn—Sb) alloy, and at least one layer includes at least one rare earth element. Suitable rare earth elements include, for example, Sc, La, Ce, Pr, Nd, Pm, Sm, Eu, Gd, Tb, Dy, Ho, Er, Tm, Yb, and Lu. In certain other embodiments, at least one layer includes a tin-antimony (Sn—Sb) alloy, and at least one layer includes a rare earth intermetallic compound of one or more rare earth elements with a non-rare earth metal. Suitable rare earth intermetallic compounds include, for example, $HoCu_2$, $Er_3Ni$, $PrCu_2$, GdRh, GdErRh, and EuTe. In yet other embodiments, at least one layer includes a tin-antimony (Sn—Sb) alloy, and at least one layer includes a solid solution alloy of rare earth elements. Suitable solid solution alloys of rare earth elements include, for example, Er—Pr, La—Ce, Ce—Pr, Gd—Tb, Dy—Ho, Er—La, Ho—Er, Nd—Sm, Nd—Y, and Gd—Y.

The cryogenic refrigerator of the present invention is constructed so as to comprise a plurality of cooling stages and alloy materials filled in at least part of a regenerative heat exchanger at a final cooling stage of the refrigerator. For example, in the case of a two-stage expansion type refrigerator, the regenerative heat exchanger material of this invention is filled in a low-temperature end of the regenerator disposed at a second cooling stage. In the case of a three-stage expansion type refrigerator, the regenerative heat exchanger material of this invention is filled in a low-temperature end of a cold-accumulating unit disposed at a third stage. On the other hand, the cold-accumulating units of the other two stages of the three-stage refrigerator, which operate at successively higher temperatures than the third stage, optimally can be filled with other regenerator materials having a high volumetric specific heat at the operating temperature of the particular cold-accumulating unit. The three-stage refrigerator may also contain the material of this invention in portions of the second and/or third stages depending on the operating temperatures of the stages and the heat capacity needed to provide the required cooling. The regenerative heat exchanger material of this invention may be used similarly in systems with more than three stages.

Figure 3:
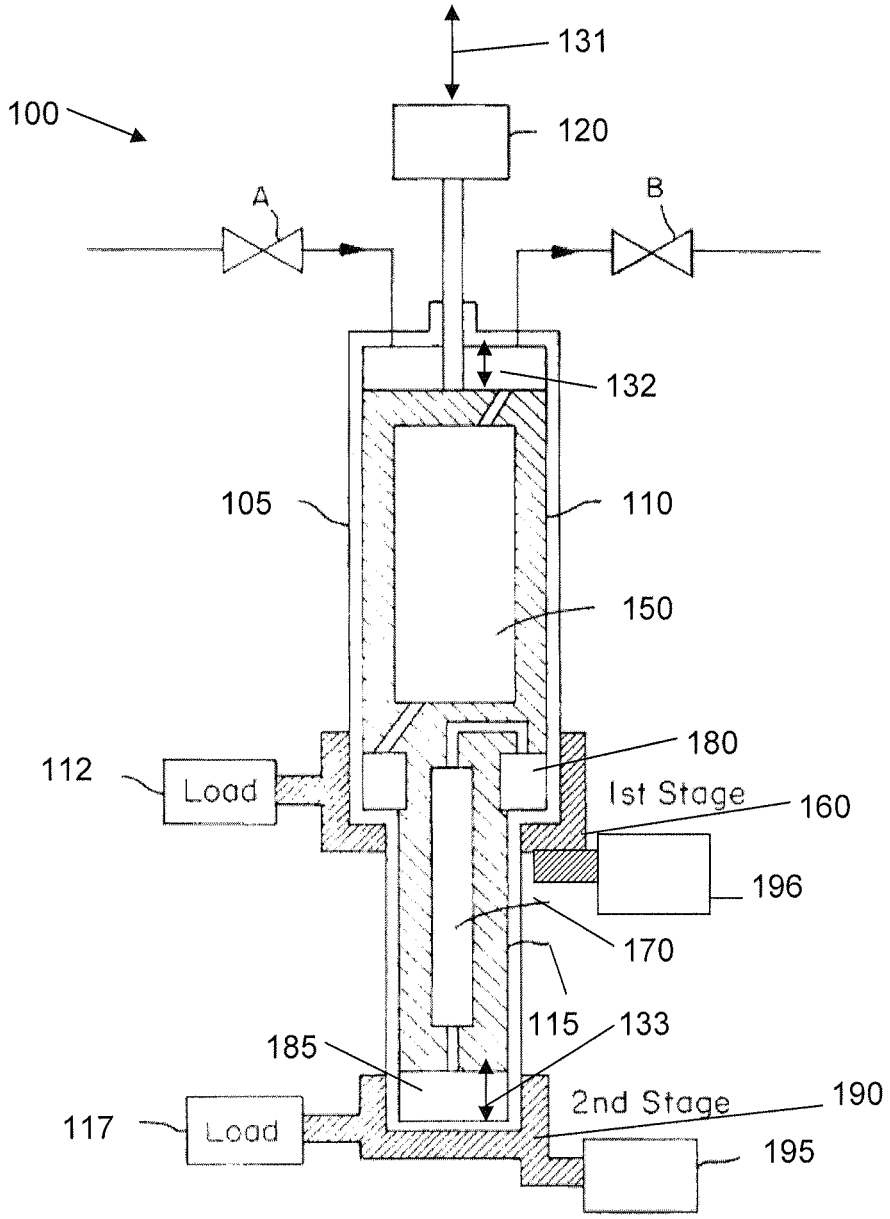
FIG. 3 is a cross section view of an embodiment of a Gifford-McMahon cryogenic refrigerator that houses regenerative heat exchanger material of the present invention.

Cryogenic refrigerators of the invention include Gifford-McMahon type cryogenic refrigerators, pulse tube cryogenic refrigerators, and Stirling type cryogenic refrigerators. One embodiment of a Gifford-McMahon cryogenic refrigerator of the invention is shown in FIG. 3. Referring now to FIG. 3, a Gifford-McMahon cryogenic refrigerator 100 includes a housing 105 that further includes first stage displacer 110 having a large diameter and second stage displacer 115 having a small diameter, which is connected coaxially to first stage displacer 110. First stage displacer 110 is driven by displacer drive motor 120 and is connected to second stage displacer 115 and freely reciprocates along with it in cylinder 105, as indicated by bi-directional arrows 131, 132, and 133.

First stage displacer 110 accommodates first stage regenerative heat exchanger material 150. In one embodiment, first stage regenerative heat exchanger material 150 can include copper or stainless steel mesh or an equivalent thereof.

In second stage displacer 115, the low temperature side contains second stage regenerative heat exchanger material 170 made of a regenerative heat exchanger material of this invention for extremely low temperature. In certain embodiments of the present invention, the regenerative heat exchanger material for operating a cryogenic refrigerator includes tin-antimony (Sn—Sb) alloy. In certain other embodiments of the present invention, the regenerative heat exchanger material can be a ternary alloy following the general formula Sn—Sb-M, wherein M is an element selected from the group consisting of Bi, Ag, Ge, Cu, La, Mg, Mn, Nd, Ni, Pd, Pt, K, Rh, Sm, Se, S, Y, Fe, In, Al, Ce, Dy, Au, Cd, Ti, P, Pr, Yb and Zn. Second stage regenerative heat exchanger material 170 is contained within second stage displacer 115 by screens or the like. In certain embodiments, first stage regenerative heat exchanger material 150 and second stage regenerative heat exchanger material 170 can include at least two layers of materials, with various volumetric heat capacities as appropriate to the temperature at the respective location in the regenerator.

First expansion chamber 180 is provided between first stage displacer 110 and second stage displacer 115. Second expansion chamber 185 is provided below second stage displacer 115. First stage cold station 160 is provided around first expansion chamber 180 and, further, second stage cold station 190 which is colder than first stage cold station 160 is provided around second expansion chamber 185. Optional heating sources 195 and 196 can be provided in contact with second stage cold station 190 and first stage cold station 160, respectively, to warm the second and first stages during operation and regular maintenance. Second stage cold station 190 has an operating temperature of about 10 K to about 25 K, and therefore it is a vacuum pumping surface for gases that condense at very low temperatures or are adsorbed by other materials at these cold temperatures. In one embodiment, there is no barrier between the helium gas and high thermal conductivity second stage cold station 190 so that there is direct thermal contact between the helium gas and second stage cold station 190. In another embodiment, either or both first stage cold station 160 and second stage cold station 190 include copper for a greater degree of thermal contact between the helium gas and the respective cold stations.

The flow of working gas refrigerant in the cryogenic refrigerator of a cryopump is cyclic. In the most basic form of a Gifford-McMahon cryogenic refrigerator, shown in FIG. 3, a source of compressed gas, i.e., a compressor, is connected to a first end of a cylinder through an inlet valve A. An exhaust valve B in an exhaust line leads from the first end to the low-pressure inlet of the compressor. With a displacer including a regenerator at a second end of the cylinder, and with the exhaust valve closed and the inlet valve open, the cylinder fills with compressed gas. With the inlet valve still open, the displacer moves to the first end to force compressed gas through the regenerator to the second end, the gas being cooled as it passes through the regenerator. When the inlet valve is closed and the exhaust valve is opened, the gas expands into the low-pressure discharge line and cools further. The resulting temperature gradient across the cylinder wall at the second end causes heat to flow from the load into the gas within the cylinder. With the exhaust valve opened and the inlet valve closed, the displacer is then moved to the second end, displacing gas back through the regenerator which returns heat to the cold gas, thus cooling the regenerator, and the cycle is completed.

To produce the low temperatures required for cryopump uses, the incoming gas must be cooled before expansion. The regenerator extracts heat from the incoming gas, stores it, and then releases it to the exhaust stream. A regenerator is a reversing-flow heat exchanger through which the helium passes alternately in either direction. The regenerator comprises a material of high surface area, high specific heat, and low thermal conductivity. Thus, the regenerator will accept heat from the helium if the helium's temperature is higher. If the helium's temperature is lower, the regenerator will release heat to the helium.

Further, a second stage of refrigeration can be added, as shown in FIG. 3, to achieve temperatures below 10 K. In the device of FIG. 3, helium enters the refrigerator through valve A and exits through valve B. Displacer drive motor 120 drives displacers 110 and 115 in the first stage and second stage, respectively. First stage displacer 110 includes first stage regenerator 150, and second stage displacer 115 includes second stage regenerator 170. Heat is extracted from first-stage thermal load 112 and second-stage thermal load 117. Heating sources 195 and 196 can optionally be provided in contact with the second and first stages to warm the second and first stages, respectively, during operation and regular maintenance. The basic operation of a Gifford-McMahon cryogenic refrigerator is described in *New Low-Temperature Gas Expansion Cycle*, H. O. McMahon and W. E. Gifford, Proceedings of the Cryogenic Engineering Conference, Advances in Cryogenic Engineering, Vol. 5 Part 1, p. 354-372 (Boulder, Colo., 1959), and U.S. Pat. Nos. 2,906,101 and 2,966,035, the entire teachings of all of which are incorporated herein by reference.

Figure 4:
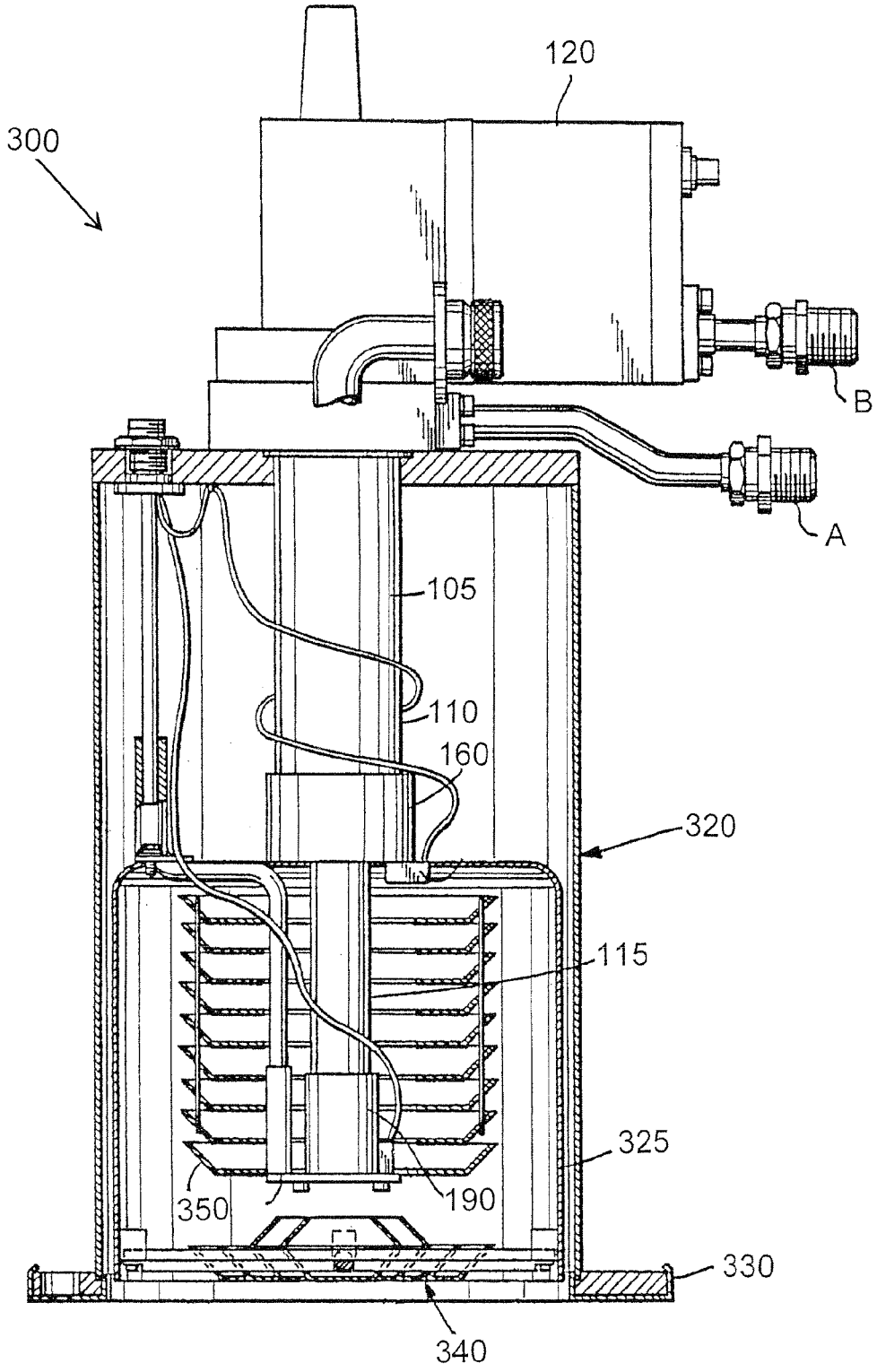
FIG. 4 is a cross section view of an embodiment of a cryopump that includes a Gifford-McMahon cryogenic refrigerator that houses regenerative heat exchanger material of the present invention.

One embodiment of a cryopump that includes a Gifford-McMahon cryogenic refrigerator is shown in FIG. 4. Referring now to FIG. 4, Gifford-McMahon cryopump 300 includes vacuum vessel 320 with vacuum vessel flange 330 containing radiation shield 325, frontal cryopanel array 340 connected to radiation shield 325, and cryopanel array 350 connected to second stage cold station 190, which is connected to second stage displacer 115 of cryogenic refrigerator 105. Inside second stage displacer 115, the low temperature side contains second stage regenerative heat exchanger material 170 (not shown) made of a regenerative heat exchanger material of this invention for extremely low temperature. Drive motor 120, working gas intake line A and exhaust line B, and first stage cold station 160 of cryogenic refrigerator 105 are also shown in FIG. 4. The components and operation of a Gifford-McMahon cryopump are described in U.S. Pat. No. 4,918,930, the entire teachings of which are incorporated herein by reference.

In certain embodiments of a Gifford-McMahon cryopump, the first stage regenerative heat exchanger material (not shown in FIG. 4) and the second stage regenerative heat exchanger material (not shown in FIG. 4) can include at least two layers as described above, with various volumetric heat capacities as appropriate to the temperature at the respective location in the regenerator. In certain other embodiments of the present invention, the regenerative heat exchanger material for operating a cryogenic refrigerator includes tin-antimony (Sn—Sb) alloy or tin-gallium (Sn—

Ga) alloy. In certain other embodiments of the present invention, the regenerative heat exchanger material can be a ternary alloy following the general formula Sn—Sb-M, wherein M is an element selected from the group consisting of Bi, Ag, Ge, Cu, La, Mg, Mn, Nd, Ni, Pd, Pt, K, Rh, Sm, Se, S, Y, Fe, In, Al, Ce, Dy, Au, Cd, Ti, P, Pr, Yb and Zn.

In certain embodiments of a Gifford-McMahon cryopump, there is no barrier between the working gas, for example, helium, and high thermal conductivity second stage cold station 190 so that there is direct thermal contact between the helium gas and second stage cold station 190. In another embodiment, either or both first stage cold station 160 and second stage cold station 190 include copper for a greater degree of thermal contact between the helium gas and the respective cold stations.

A cryopump can include a pulse tube refrigerator. Pulse tube refrigerators are regenerative refrigerators in which a pressure wave travels back and forth through a buffer tank, a pulse tube, and a section containing the regenerative heat exchanger material. The pressure wave creates an oscillating gas column, called a gas piston, that functions as a compressible displacer to move the working gas back and forth through the regenerative heat exchanger material. In this process, one end of the pulse tube is cooled, creating a cold station region, and the other end of the pulse tube is heated, creating a hot station region, where heat is dissipated away from the refrigerator. The pressure wave can be created by a compressor connected to the pulse tube refrigerator by high and low pressure gas lines, or by oscillators such as acoustic sources and pistons, and therefore a pulse tube refrigerator has no moving parts at the cold end. Some pulse tube refrigerators contain an orifice between the pulse tube and the buffer tank to act as a flow resistance to enable proper phasing of the gas motion and pressure wave. Pulse tube refrigerators can be single stage or can contain multiple stages. The basic operation of a pulse tube refrigerator is described in *Development of the Pulse Tube Refrigerator as an Efficient and Reliable Cryocooler*, R. Radebaugh, Proceedings of the Institute of Refrigeration, Vol. 96 (London, 1999/2000), the entire teachings of which are incorporated herein by reference.

Figure 5:
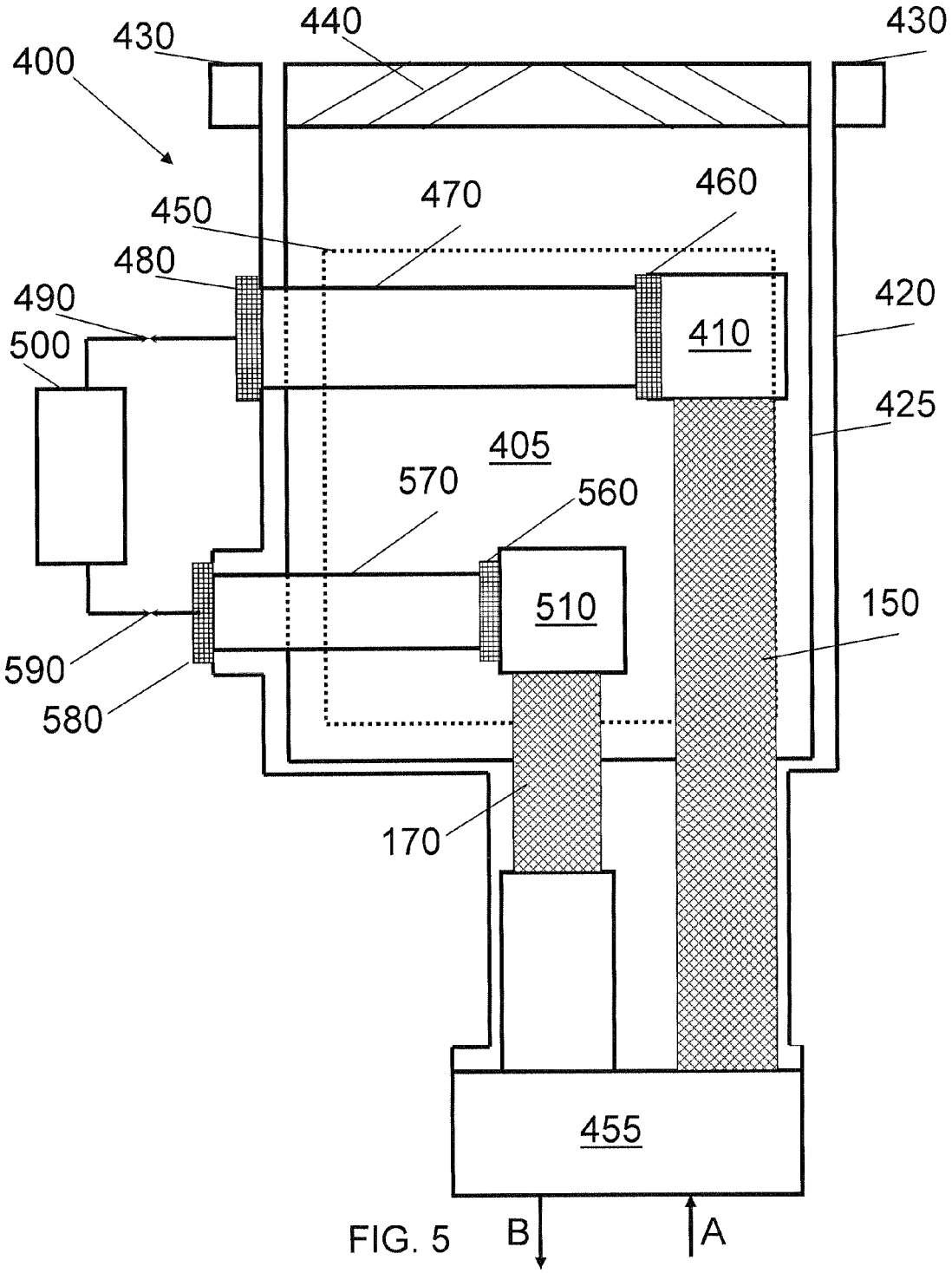
FIG. 5 is a cross section view of an embodiment of a cryopump that includes a pulse tube cryogenic refrigerator that houses regenerative heat exchanger material of the present invention.

One embodiment of a cryopump that includes a pulse tube cryogenic refrigerator is shown in FIG. 5. Referring now to FIG. 5, pulse tube cryopump 400 includes vacuum vessel 420 with vacuum flange 430 containing radiation shield 425, frontal cryopanel array 440, and cryopanel array 450. Pulse tube refrigerator 405 includes high pressure gas inlet A, connected to valve assembly 455, which is in fluid communication with first stage pulse tube refrigerator assembly 410, buffer tank 500, second stage refrigerator pulse tube assembly 510, and low pressure gas outlet B. First stage pulse tube refrigerator assembly 410 includes first stage heat exchanger 150, which is connected to first stage cold station 460, which is in fluid communication with first stage pulse tube 470, first stage hot station 480, and first stage flow restriction orifice 490. Second stage pulse tube refrigerator assembly 510 includes second stage heat exchanger 170, which is connected to second stage cold station 560, which is in fluid communication with second stage pulse tube 570, second stage hot station 580, and second stage flow restriction orifice 590. The components and operation of a pulse tube cryopump are described in U.S. Pat. No. 7,201,004, the entire teachings of which are incorporated herein by reference.

In one embodiment of the cryopump shown in FIG. 5, first regenerative heat exchanger material 150 can include copper mesh or an equivalent thereof. In certain embodiments of a pulse tube cryopump, first stage regenerative heat exchanger material 150 and second stage regenerative heat exchanger material 170 can include at least two layers as described above, with various volumetric heat capacities as appropriate to the temperature at the respective location in the regenerator. In certain other embodiments of the present invention, the regenerative heat exchanger material for operating a pulse tube refrigerator includes tin-antimony (Sn—Sb) alloy or tin-gallium (Sn—Ga) alloy. In certain other embodiments of the present invention, the regenerative heat exchanger material can be a ternary alloy following the general formula Sn—Sb-M, wherein M is an element selected from the group consisting of Bi, Ag, Ge, Cu, La, Mg, Mn, Nd, Ni, Pd, Pt, K, Rh, Sm, Se, S, Y, Fe, In, Al, Ce, Dy, Au, Cd, Ti, P, Pr, Yb and Zn.

In certain embodiments of a pulse tube cryopump, there is no barrier between the working gas, for example, helium, and high thermal conductivity second stage cold station 560 so that there is direct thermal contact between the helium gas and second stage cold station 560. In another embodiment, either or both first stage cold station 460 and second stage cold station 560 include copper for a greater degree of thermal contact between the helium gas and the respective cold stations.

Figure 6:
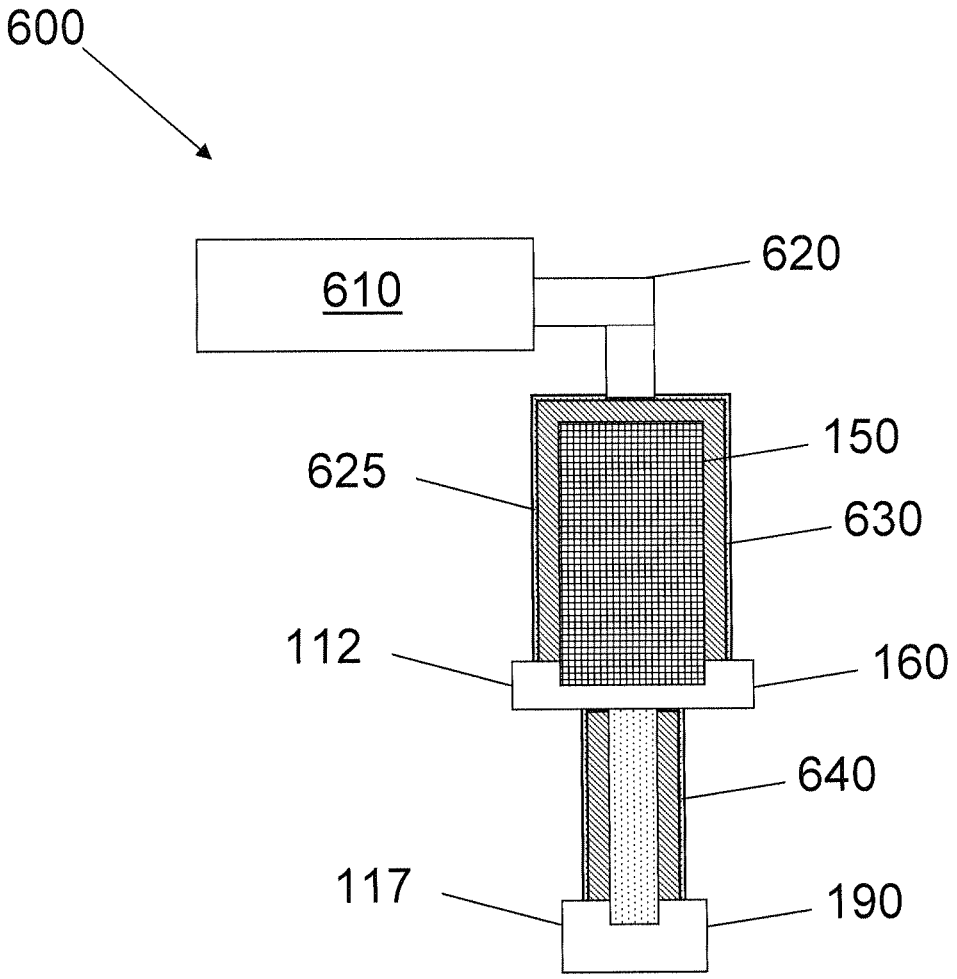
FIG. 6 is a cross section view of an embodiment of a split Stirling cryogenic refrigerator that houses regenerative heat exchanger material of the present invention.

A cryopump can include a Stirling cryogenic refrigerator. One embodiment of a two-stage Stirling cryogenic refrigerator is shown in FIG. 6. Referring now to FIG. 6, Stirling cryogenic refrigerator 600 includes pressure wave source 610, pressure wave transfer line 620, a housing 625 that further includes first stage displacer 630 having a large diameter and second stage displacer 640 having a small diameter, which is connected coaxially to first stage displacer 630.

In certain embodiments of a Stirling cryogenic refrigerator, first stage regenerative heat exchanger material 150 and second stage regenerative heat exchanger material 170 can include at least two layers as described above, with various volumetric heat capacities as appropriate to the temperature at the respective location in the regenerator. First stage displacer 630 accommodates first stage regenerative heat exchanger material 150. In one embodiment, first stage regenerative heat exchanger material 150 can include copper or stainless steel mesh or an equivalent thereof.

In second stage displacer 640, the low temperature side contains second stage regenerative heat exchanger material 170 made of a regenerative heat exchanger material of this invention for extremely low temperature that includes tin-antimony (Sn—Sb) alloy.

Figure 7:
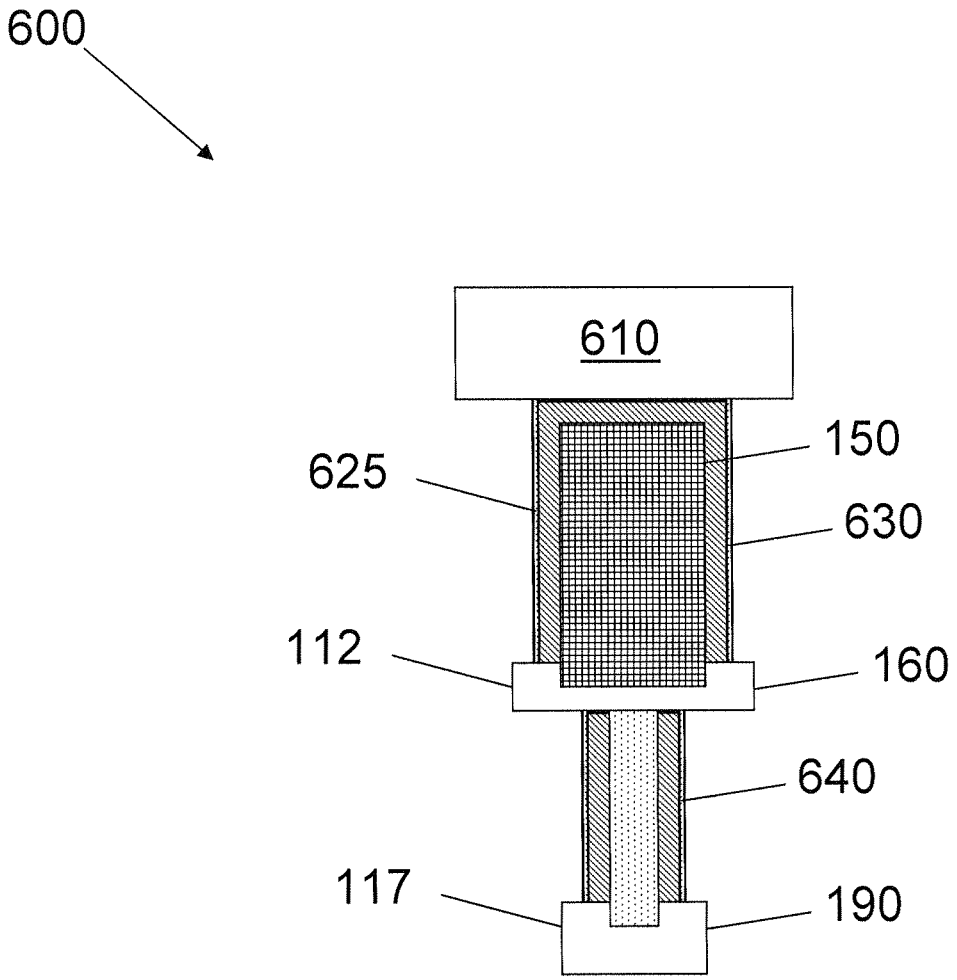
FIG. 7 is a cross section view of an embodiment of an integral Stirling cryogenic refrigerator that houses regenerative heat exchanger material of the present invention.

First stage cold station 160 is provided at the end of first stage displacer 630 distal from pressure wave source 610, and, further, second stage cold station 190 which is colder than first stage cold station 160 is provided at the end of second stage displacer 640 distal from first stage cold station 160. Second stage cold station 190 has an operating temperature of about 10 K to about 25 K, and therefore it is a vacuum pumping surface for gases that condense at very low temperature or are adsorbed by other materials at these cold temperatures. Heat is extracted from first stage thermal load 112 and second stage thermal load 117. In another embodiment of a Stirling cryogenic refrigerator, pressure wave source 610 can be a piston or an acoustic source. In yet another embodiment of a Stirling cryogenic refrigerator, shown in FIG. 7, pressure wave source 610 is integral with housing 625, and therefore pressure wave transfer line 620 is not necessary. Referring now to FIG. 7, all of the items shown are previously described above for FIG. 6.

Figure 8:
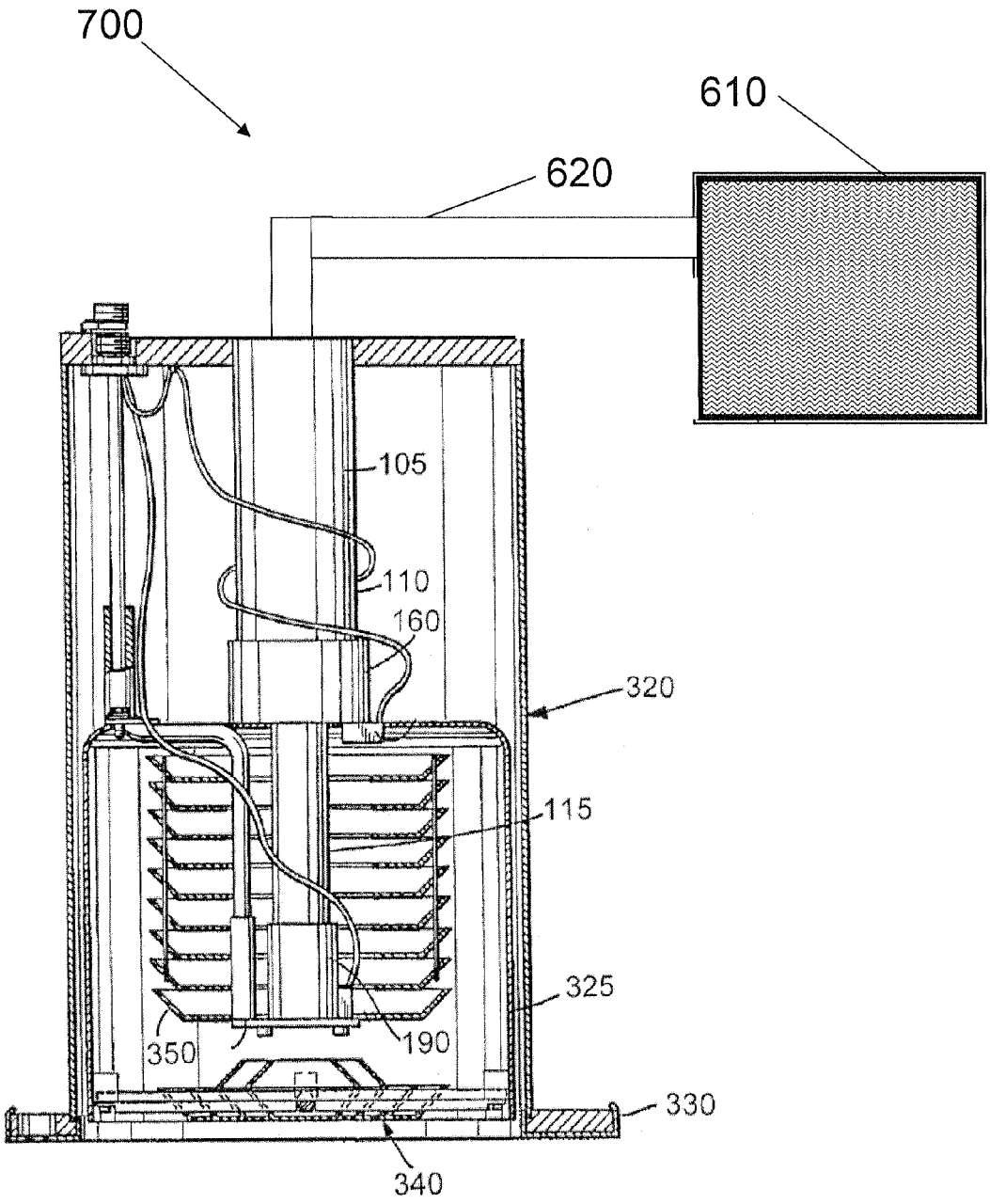
FIG. 8 is a cross section view of an embodiment of a cryopump that includes a split Stirling cryogenic refrigerator that houses regenerative heat exchanger material of the present invention.
Figure 9:
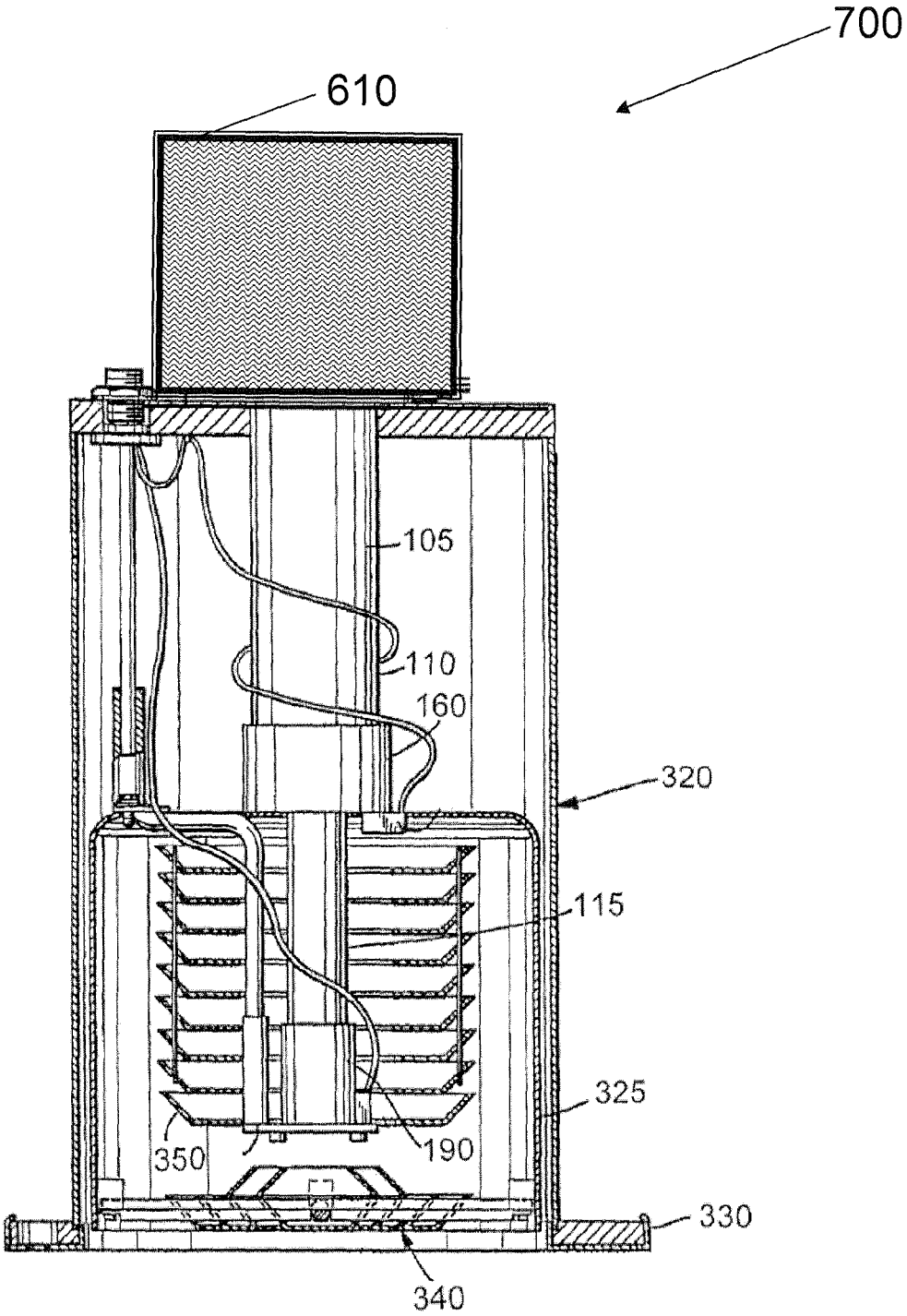
FIG. 9 is a cross section view of an embodiment of a cryopump that includes an integral Stirling cryogenic refrigerator that houses regenerative heat exchanger material of the present invention.

One embodiment of a cryopump that includes a two-stage Stirling cryogenic refrigerator is shown in FIG. 8. Referring now to FIG. 8, cryopump 700 includes pressure wave source 610 connected to pressure wave transfer line 620, vacuum vessel 320 with vacuum vessel flange 330 containing radiation shield 325, frontal cryopanel array 340 connected to radiation shield 325, and cryopanel array 350 connected to second stage cold station 190, which is connected to second stage displacer 115 of cryogenic refrigerator 105. Inside second stage displacer 115, the low temperature side contains second stage regenerative heat exchanger material 170 (not shown) made of a regenerative heat exchanger material of this invention for extremely low temperature that includes tin-antimony (Sn—Sb) alloy. In another embodiment of a cryopump that includes a Stirling cryogenic refrigerator, pressure wave source 610 can be a piston or an acoustic source. In yet another embodiment of a Stirling cryogenic refrigerator, shown in FIG. 9, pressure wave source 610 is integral with vacuum vessel 320, and therefore pressure wave transfer line 620 is not necessary. Referring now to FIG. 9, all of the items shown are previously described above for FIG. 8.

EXEMPLIFICATION

Figure 10:
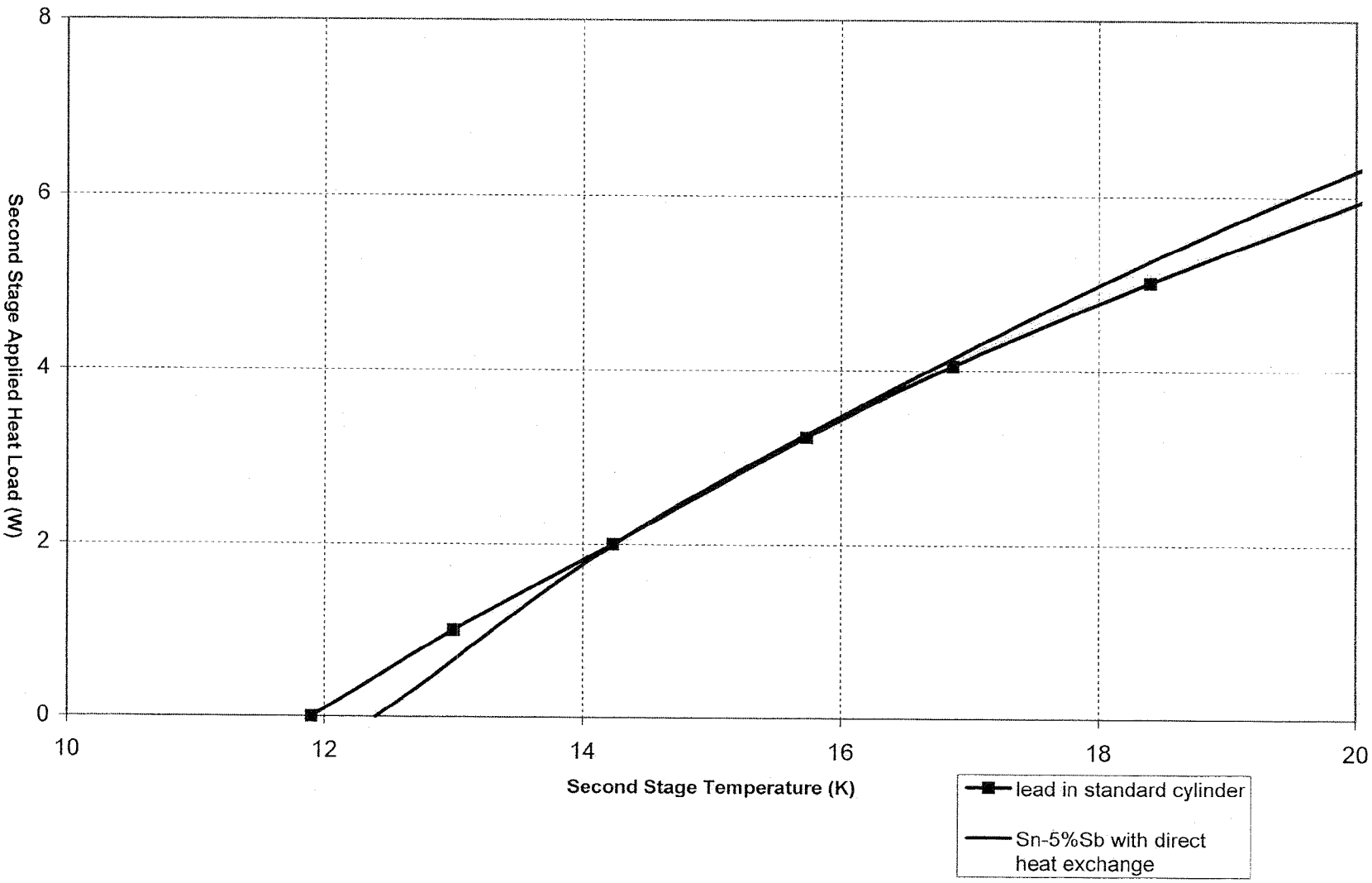
FIG. 10 is a graph of the temperature of the second stage (degrees Kelvin) as a function of the heat load (Watts) applied to the second stage of a cryogenic refrigerator including regenerative heat exchanger materials composed of 95% Sn 5% Sb by weight as compared to lead (Pb).

Regenerative heat exchanger materials in the form of 0.28 mm diameter round shot with a composition of 95% Sn by weight and 5% Sb by weight were tested in a standard two stage Gifford-McMahon refrigerator. The Sn—Sb regenerative materials of uniform size and composition were contained in heat exchanger 170 of the second stage displacer 115 of Gifford-McMahon refrigerator 100, shown in FIG. 3. The second stage was configured for direct thermal contact between the helium working gas refrigerant and copper heat station 190, shown in FIG. 3. Test conditions included various settings of the temperature of the first stage, and various reciprocation rates of displacer drive motor 120, shown in FIG. 3. The first stage temperature setting was controlled by changing the heat load to the first stage to maintain the required temperature. The heat load on the second stage was gradually increased and the temperature of the second stage was monitored. FIG. 10 shows a graph of the temperature of the second stage (degrees Kelvin) as a function of the heat load (Watts) applied to the second stage for a displacer operating at a motor speed of 72 rotations per minute (rpm) for regenerative heat exchanger materials composed of 95% Sn 5% Sb by weight as compared to lead (Pb) in a standard Gifford-McMahon refrigerator.

The teachings of all patents, published applications and references cited herein are incorporated by reference in their entirety.

EQUIVALENTS

While this invention has been particularly shown and described with references to example embodiments thereof, it will be understood by those skilled in the art that various changes in form and details may be made therein without departing from the scope of the invention encompassed by the appended claims.

What is claimed is:

1. A cryogenic refrigerator comprising at least one cooling stage having a regenerative heat exchanger material in thermal contact with a working gas, including a binary tin-gallium (Sn—Ga) alloy in the at least one cooling stage.

2. The cryogenic refrigerator of claim 1, wherein the cryogenic refrigerator is selected from the group consisting of a Gifford-McMahon cryogenic refrigerator, a pulse tube cryogenic refrigerator, and a Stirling cryogenic refrigerator.

3. The cryogenic refrigerator of claim 1, wherein the Sn—Ga alloy comprises a maximum of 3.9% gallium by weight.

4. The cryogenic refrigerator of claim 1, further including a cryopump that includes at least one cryopanel cooled by the refrigerator and adapted to condense or adsorb gases.

5. The cryogenic refrigerator of claim 1, wherein the at least one cooling stage includes at least two layers of regenerative heat exchanger material.

6. The cryogenic refrigerator of claim 5, wherein at least one layer includes the binary tin-gallium (Sn—Ga) alloy and at least one layer includes at least one rare earth element.

7. The cryogenic refrigerator of claim 5, wherein at least one layer includes the binary tin-gallium (Sn—Ga) alloy and at least one layer includes a rare earth intermetallic compound of one or more rare earth elements with a non-rare earth metal.

8. The cryogenic refrigerator of claim 5, wherein at least one layer includes the binary tin-gallium (Sn—Ga) alloy and at least one layer includes a solid solution alloy of rare earth elements.

* * * * *